United States Patent [19]

McKay et al.

[11] Patent Number: 5,015,977

[45] Date of Patent: May 14, 1991

[54] CIRCUIT BREAKER POSITIVE TRIP INDICATION SPRING

[75] Inventors: Geoffrey H. McKay, West Hartford; Andrew M. Candelora, East Haven; Michael C. Guerrette, Plymouth, all of Conn.

[73] Assignee: General Electric Company, New York, N.Y.

[21] Appl. No.: 561,752

[22] Filed: Aug. 2, 1990

[51] Int. Cl.[5] ..... H01H 73/12

[52] U.S. Cl. ..... 335/17; 335/167; 335/172; 335/23

[58] Field of Search ..... 335/8-10, 335/21-23, 167-174, 17

[56] References Cited

U.S. PATENT DOCUMENTS 3,970,976 7/1976 Nicol ..... 335/21
4,123,734 10/1978 Maier et al. ..... 335/9
4,302,740 11/1981 Maier et al. ..... 335/169
4,796,154 1/1989 Morris et al. ..... 361/353
4,888,570 12/1989 Toda ..... 335/167

FOREIGN PATENT DOCUMENTS 299440 1/1989 European Pat. Off. .

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A positive trip indication spring is used with circuit breakers that provide colored trip indication through a visual access opening in the circuit breaker cover to ensure that the trip indicia on the circuit breaker operating handle align with the visual access opening upon the occurrence of a trip condition. The trip indication spring cooperates with the powerful circuit breaker operating mechanism springs to provide additional bias to the circuit breaker operating handle to move the operating handle to its fully "TRIPPED" position.

9 Claims, 5 Drawing Sheets

CIRCUIT BREAKER POSITIVE TRIP INDICATION SPRING

BACKGROUND OF THE INVENTION

Molded case circuit breakers having contact status indication such as described in U.S. Pat. No. 4,796,154 include colored indicia formed on the circuit breaker operating handle skirt that align with a visual access slot formed in the circuit breaker cover to visually ascertain the operating conditions of the circuit breaker contacts. Three different colors are employed to differentiate between the "ON", "TRIPPED" and "OFF" conditions of the circuit breaker contacts. The TRIPPED color is located intermediate the ON and OFF colors and represents to an operator that the circuit breaker operating mechanism has been articulated to separate the circuit breaker contacts. State-of-the-Art circuit breaker operating handles that carry the colored indicia rely upon the return bias provided by the circuit breaker operating mechanism springs to return the operating handle to its center or TRIPPED position.

When a handle extender unit such as that described within U.S. patent application Ser. No. 546,826 entitled "Compact Molded Case Circuit Breaker with Increased Ampere Rating" is attached to the circuit breaker operating handle, the return bias provided by the operating mechanism springs is insufficient to exactly align the trip indicia under the visual access slot described earlier. The operator is then not completely assured that the circuit breaker contacts are in their TRIPPED condition.

When a remote actuator, such as described within U.S. patent application Ser. No. 561,760 entitled "Molded Case Circuit Breaker Variable Actuator Mechanism" is used to remotely turn the circuit breaker contacts between their ON and OFF conditions, the added resistance to the return bias of the operating mechanism springs by the connection between the operating handle and the remote operator may prevent the TRIPPED indicia from directly aligning under the visual access slot.

One purpose of the instant invention is to provide means for ensuring that the TRIP indicating indicia on the circuit breaker operating handle skirt will correctly align with the visual access slot when the circuit breaker operating mechanism is articulated to separate the circuit breaker contacts.

SUMMARY OF THE INVENTION

The invention comprises a supplemental positive trip indication spring interacting between the circuit breaker operating mechanism housing and the circuit breaker operating handle yoke to drive the handle yoke and attached operating handle to the TRIPPED position upon articulation of the circuit breaker operating mechanism.

DESCRIPTION OF THE PREFERRED EMBODIMENT

Figure 1:
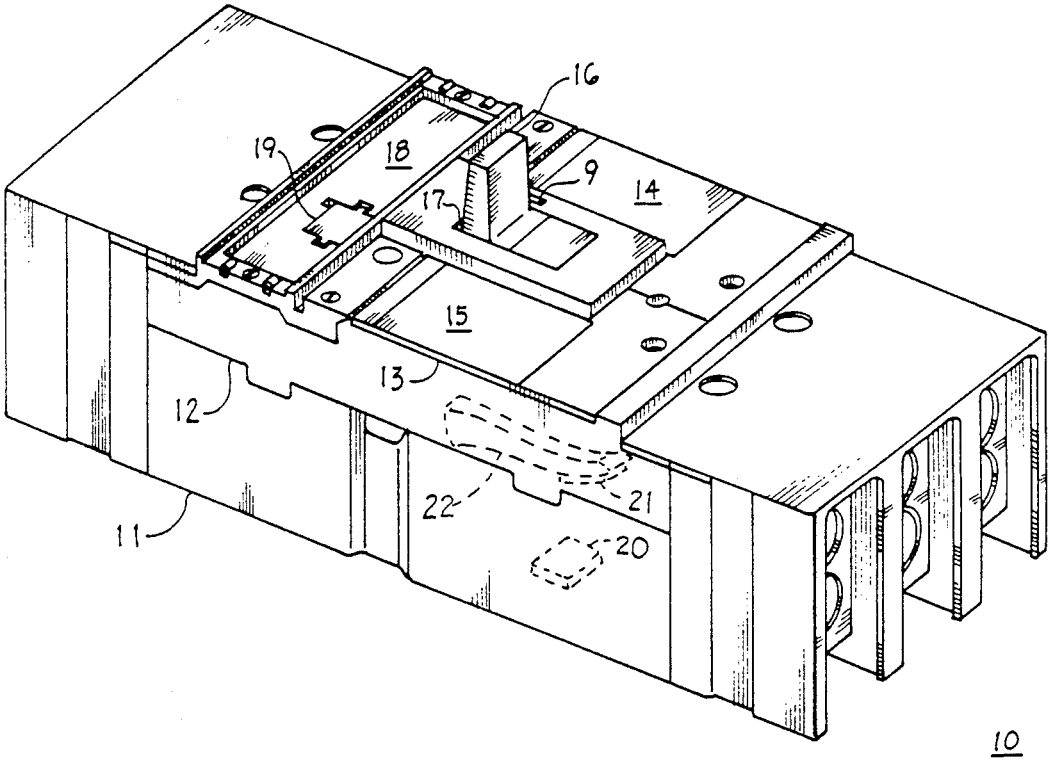
FIG. 1 is a top perspective view of a molded case circuit breaker including the positive trip indication spring in accordance with the invention.

An electronic trip circuit breaker, hereafter "circuit breaker" 10 is depicted in FIG. 1 and consists of a molded plastic case 11 to which a molded plastic cover 12 is fixedly secured. Although not shown, an operating mechanism is arranged to automatically drive a movable contact arm 22 and attached movable contact 21 away from the fixed contact 20 upon the occurrence of predetermined overcurrent conditions for a predetermined period of time to interrupt circuit current. An electronic trip unit 18 is positioned within the circuit breaker cover and a rating plug 19 electrically connects with the trip unit to set the circuit breaker ampere rating. An operating handle 16 extends through an access slot 17 for manual intervention to turn the circuit breaker contacts between their open and closed conditions. A visual access slot 9 formed through the circuit breaker cover allows for operator verification of the condition of the circuit breaker contacts. Accessory doors 14, 15 formed within the accessory cover 13 allow access to selected circuit breaker accessories contained therein. The circuit breaker operating handle 16 is in its upright "TRIPPED" position which occurs when the operating mechanism has become articulated to drive the movable contact arm 22 and movable contact 21 to the position indicated in FIG. 1.

Figure 2:
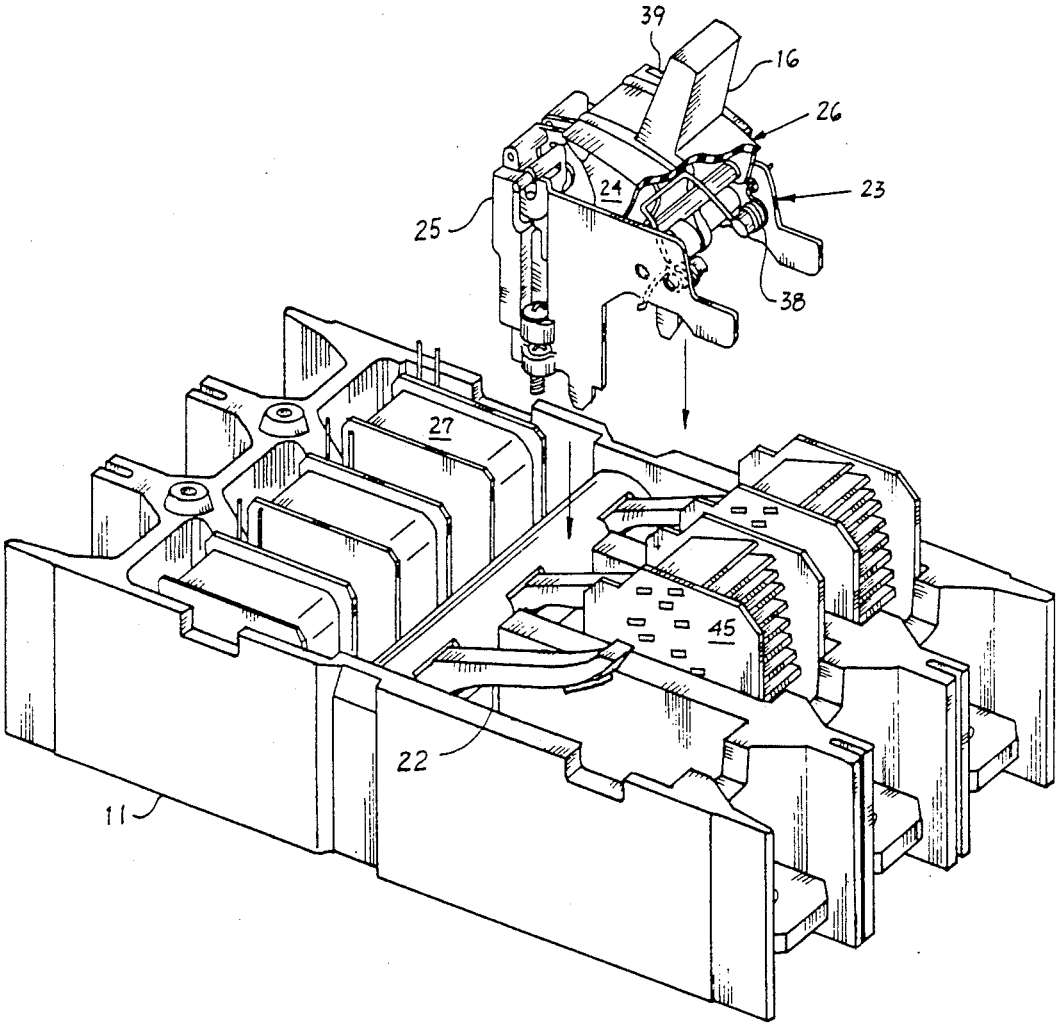
FIG. 2 is a top perspective view of the circuit breaker of FIG. 1 with the operating mechanism and operating handle assembly in isometric projection.

The circuit breaker case 11 is shown in FIG. 2 prior to installing an operating mechanism 23 to which the latch assembly 25, handle yoke 24 and positive trip indication spring 38 have been preassembled. The latch assembly and operating mechanism are described within U.S. patent application Ser. No. 526,481 filed May 21, 1990, entitled "Molded Case Circuit Breaker Compact Latch Assembly", which Application is incorporated herein for purposes of reference. The operating handle 16 is attached to the handle yoke by means of the handle skirt portion 26. As described within U.S. patent application Ser. No. 558909 entitled "Molded Case Circuit Interrupter Trip Indicating Handle", colored trip indicia 39 is printed onto the handle skirt and is visually ascertained through the visual access slot 9 shown earlier in FIG. 1. The current transformers 27, movable contact arms 22 and arc chutes 45 are assembled within the circuit breaker case before the operating mechanism, latch assembly and handle yoke are assembled as a single unit.

Figure 3:
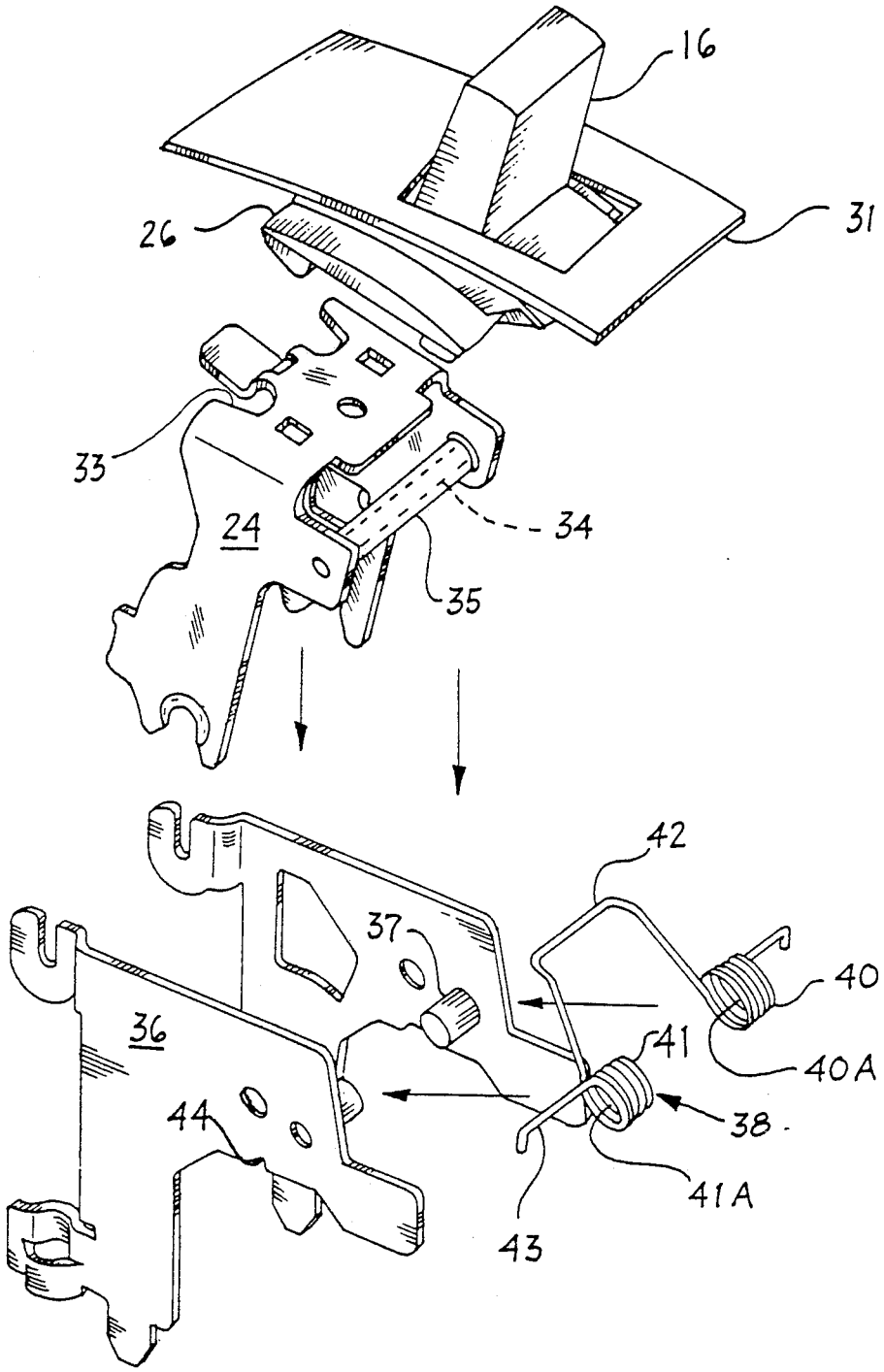
FIG. 3 is a top perspective view of the operating mechanism and handle assembly components prior to the assembly of the positive trip indication spring.

The preassembly of the operating handle 16 and handle yoke 24 onto the operating mechanism side frames 36 is best seen by referring now to FIG. 3. The handle yoke 24 is positioned within the operating mechanism side frames and the operating handle 16 with the handle shutter 31 positioned over the handle skirt 26 is attached to the handle yoke by engagement with the slots 33 formed in the top surface of the handle yoke. In accordance with the invention, the positive trip indication spring 38, hereafter "indication spring" is attached to the mechanism side frames. The indication spring is formed from a pair of torsion coils 40, 41 of a spring steel composition and are joined by means of a crossover loop 42. A pair of hooks 43 extending from the bottom of the loops engage corresponding notches 44 formed through the mechanism side frames while the openings 40A, 41A defined within the spring loops are received on the support posts 37 that are formed on the interior surfaces of the mechanism side frames. When the indication spring is installed upon the mechanism side frames, the crossover loop 42 rests against the crossarm 34 extending between the side parts of the handle yoke 24. A roller 35 positioned over the crossarm prevents the crossover loop from bearing directly on the crossarm.

Figure 4A:
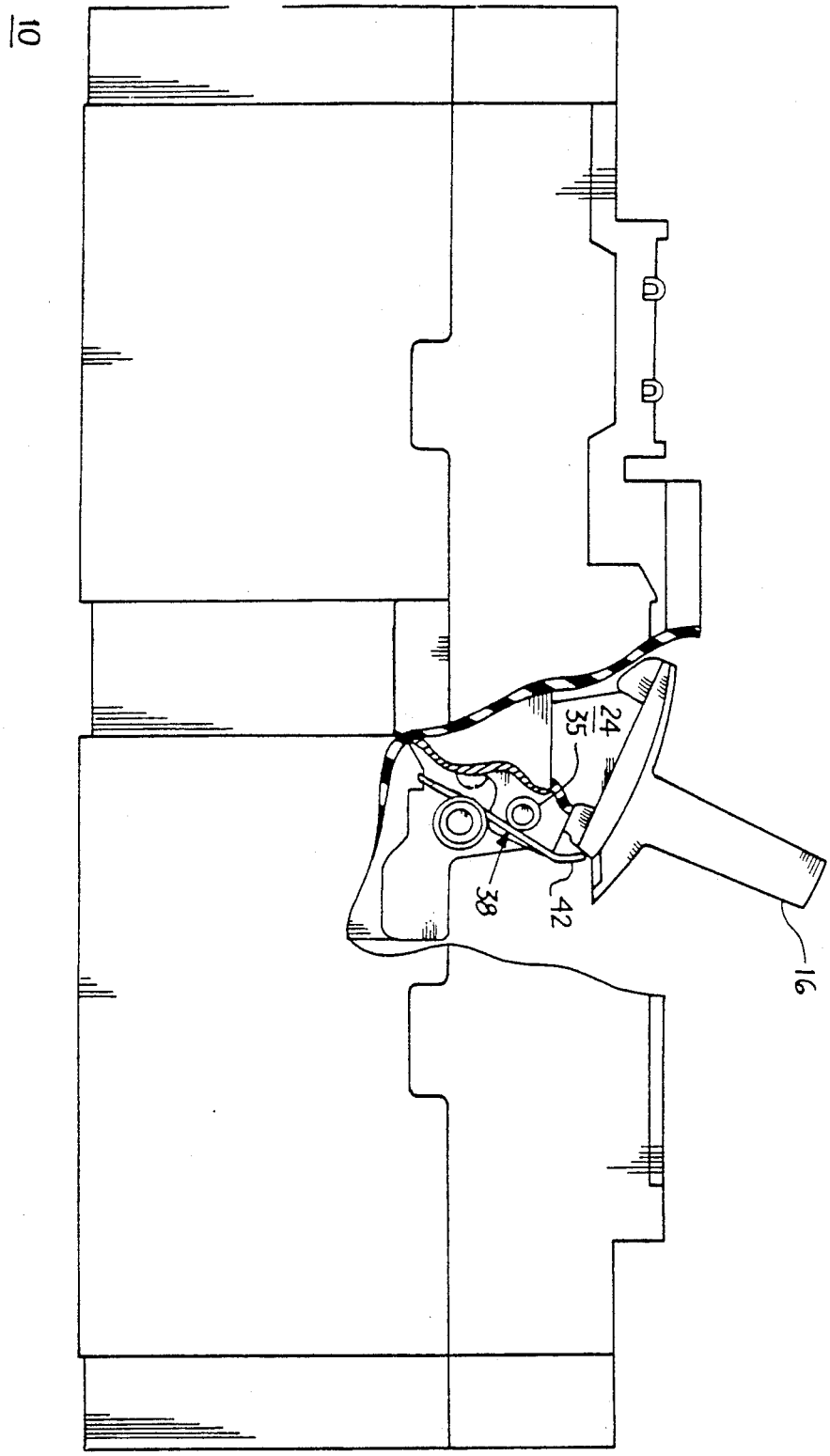
FIGS. 4A and 4B are cutaway side views of the circuit breaker of FIG. 1 depicting the circuit breaker operating handle in the "ON" and "TRIPPED" positions respectively.
Figure 4B:
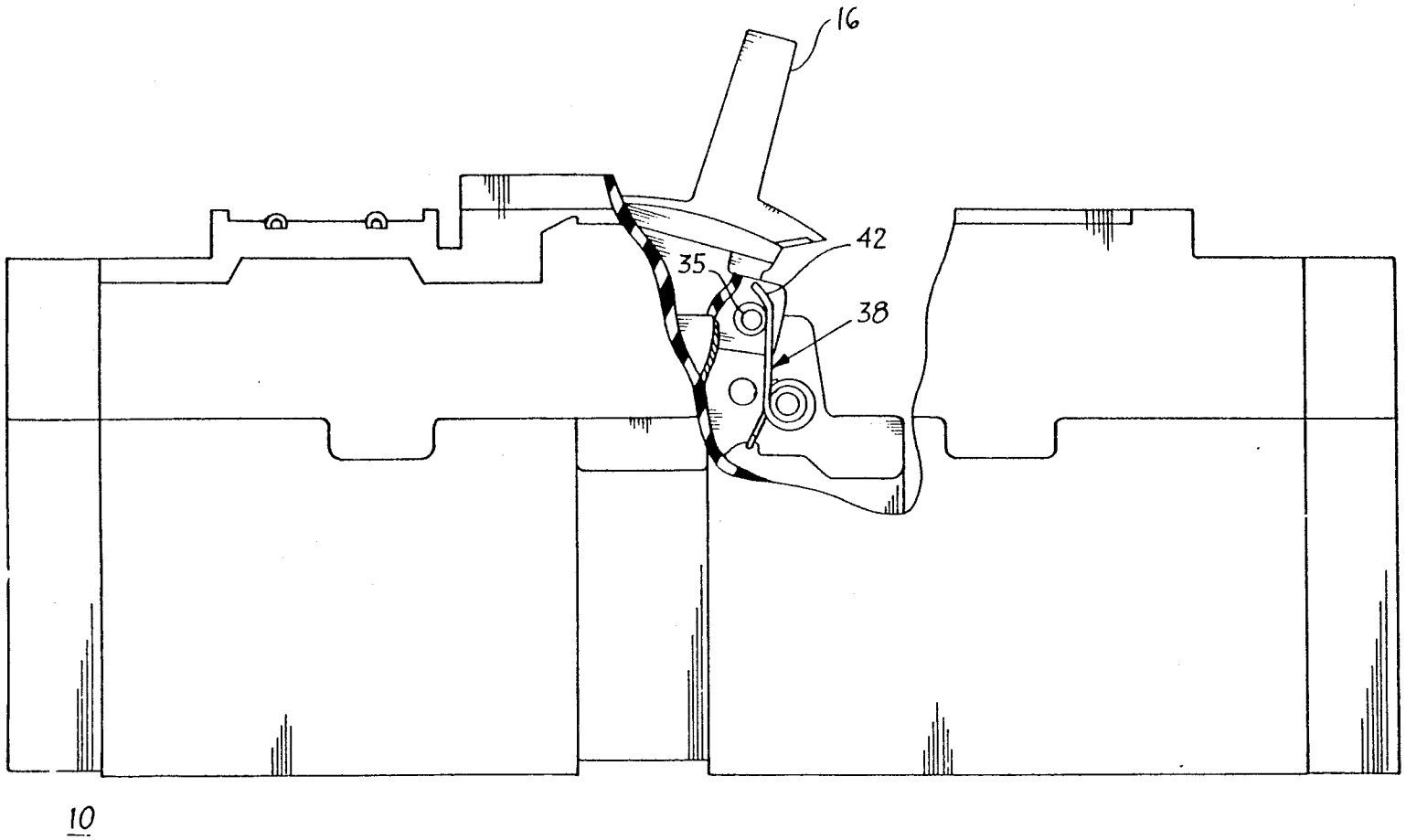

The operation of the indication spring is best seen by referring now to FIGS. 4A and 4B. When the operating handle 16 is moved to the ON position depicted in FIG. 4A, the roller 35 moves downwardly along the crossover loop 42 on the trip indication spring 38 rotating the indication spring in the clockwise direction as viewed in FIG. 4A and loading the indication spring to effect a return bias to the operating handle via the handle yoke 24. The operating mechanism springs (not shown) hold the operating handle and the roller 35 against the return bias inserted by the trip indication spring 38. Upon the occurrence of an overcurrent condition, the operating mechanism responds to drive the circuit breaker contacts to their TRIPPED condition while at the same time the operating mechanism springs drive the operating handle 16 to the TRIPPED position indicated in FIG. 4B. The additional bias provided by the crossover loop 42 against the roller 35 assists the operating springs in driving the operating handle 16 to the upright TRIPPED position depicted in FIG. 4B. The force provided by the trip indication spring is slight compared to the force provided by the powerful operating springs and hence does not interfere with the movement of the operating handle to the ON position. When the operating springs over-center to drive the movable contact arm to its open position, the reverse bias of the trip indication spring supplements the bias provided by the operating springs on the handle yoke to further assist the operating springs in driving the handle yoke and operating handle to the TRIPPED position.

Having thus described our invention, what we claim as new and desire to secure by Letters Patent is:

1. A compact industrial-rated circuit breaker comprising:

a molded plastic cover and case;

a pair of contacts within said case arranged for automatic separation upon occurrence of an overcurrent condition through a protected circuit;

an operating mechanism within said case connected with said contacts for causing said contact separation, said operating mechanism being supported between a pair of side frames;

a pair of operating springs within said operating mechanism for providing opening force to said contacts;

an operating handle attached to said operating mechanism for manually opening and closing said contacts;

a handle yoke attached to said operating mechanism and said operating handle;

a visual access slot formed in said cover for providing indication of the condition of said contacts; and a trip indication spring associated with said operating handle providing additive force to the operating springs to move said handle yoke and said operating handle under said access slot when said operating handle is driven to a tripped position; and a trip indication spring associated with said operating handle.

2. The circuit breaker of claim 1 wherein said trip indication spring comprises a pair of spring coils joined by a crossover arm.

3. The circuit breaker of claim 2 wherein said side frames include a pair of projections opposedly adjacent each other, said spring coils being supported on said projections.

4. The circuit breaker of claim 3 including a pair of hooks formed on said indication spring, said hooks being received within corresponding slots formed within said side frames.

5. The circuit breaker of claim 2 wherein said yoke includes a pair of opposing sidewalls.

6. The circuit breaker of claim 5 including a crosspiece extending between said sidewalls.

7. The circuit breaker of claim 6 wherein said crossover arm interacts with said crosspiece to bias said indication spring when said operating handle is rotated to close said contacts.

8. The circuit breaker of claim 7 including a roller supported on said crosspiece.

9. The circuit breaker of claim 1 wherein said operating handle includes colored indicia displaying the condition of said contacts.

* * * * *